US006792907B1

(12) United States Patent
Kostun et al.

(10) Patent No.: US 6,792,907 B1
(45) Date of Patent: Sep. 21, 2004

(54) HELMHOLTZ RESONATOR

(75) Inventors: John D. Kostun, Brighton, MI (US); Lakhi N. Goenka, Ann Arbor, MI (US); David J. Moenssen, Canton, MI (US); Christopher E. Shaw, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/378,767

(22) Filed: Mar. 4, 2003

(51) Int. Cl.[7] ..... F02M 35/10

(52) U.S. Cl. ..... 123/184.57; 181/229; 181/250

(58) Field of Search ..... 123/184.55, 184.53, 123/184.57; 181/229, 241, 250

(56) References Cited

U.S. PATENT DOCUMENTS

| | | | | |
|---|---|---|---|---|
| 4,538,556 A | * | 9/1985 | Takeda | 123/184.57 |
| 4,539,947 A | | 9/1985 | Sawada et al. | |
| 4,546,733 A | | 10/1985 | Fukami et al. | |
| 4,928,638 A | | 5/1990 | Overbeck | |
| 4,974,568 A | | 12/1990 | Cser | |
| 5,216,985 A | | 6/1993 | Brummer et al. | |
| 5,333,576 A | | 8/1994 | Verkleeren | |
| 5,377,629 A | | 1/1995 | Brackett et al. | |
| 5,474,039 A | | 12/1995 | Doragrip | |
| 5,621,656 A | * | 4/1997 | Langley | 700/280 |
| 5,628,287 A | | 5/1997 | Brackett et al. | |
| 5,662,086 A | | 9/1997 | Piccinini | |
| 5,722,358 A | | 3/1998 | Fuesser et al. | |
| 5,771,851 A | | 6/1998 | McLean | |
| 5,894,823 A | | 4/1999 | Lee | |
| 6,047,677 A | | 4/2000 | Kim | |
| 6,105,546 A | | 8/2000 | Fuesser et al. | |
| 6,192,850 B1 | | 2/2001 | Rutschmann et al. | |
| 6,250,272 B1 | | 6/2001 | Rutschmann et al. | |
| 6,289,864 B1 | | 9/2001 | Vide et al. | |
| 6,295,363 B1 | * | 9/2001 | Laak et al. | 381/94.1 |
| 6,422,192 B1 | | 7/2002 | Bloomer | |
| 6,698,390 B1 | * | 3/2004 | Kostun et al. | 123/184.57 |
| 2002/0000343 A1 | | 1/2002 | Paschereit et al. | |

FOREIGN PATENT DOCUMENTS

| | | |
|---|---|---|
| GB | 398359 | 9/1933 |
| GB | 1512014 A | 5/1978 |
| GB | 2088951 A | 6/1982 |
| JP | 57135212 A | 8/1982 |
| JP | 58124057 A | 7/1983 |
| JP | 02215925 A | 8/1990 |
| JP | 03107522 A | 5/1991 |
| JP | 04031625 A | 2/1992 |
| JP | 07319481 A | 12/1995 |
| JP | 10240267 A | 9/1998 |
| JP | 2000130145 A | 5/2000 |

* cited by examiner

*Primary Examiner*—Andrew M. Dolinar
*Assistant Examiner*—Katrina B. Harris
(74) *Attorney, Agent, or Firm*—MacMillan, Sobanski & Todd LLC

(57) ABSTRACT

A continuously variable Helmholtz resonator for a vehicle air intake system having a vibratory input to the resonator wall to dynamically adjust the cancellation frequency for time-varying acoustical signals, and at least one of mean resonator volume control, mean resonator neck length control, and mean resonator neck diameter control whereby control of both the dynamic and the mean properties of the resonator provides a wide-tuning spectrum and facilitates canceling of time-varying acoustical signals.

20 Claims, 6 Drawing Sheets

HELMHOLTZ RESONATOR

FIELD OF THE INVENTION

The invention relates to a resonator and more particularly to a tunable Helmholtz resonator for a vehicle air intake system having a vibratory input to the resonator wall to dynamically adjust the cancellation frequency for time-varying acoustical signals, and at least one of mean resonator volume control, mean resonator neck length control, and mean resonator neck diameter control.

BACKGROUND OF THE INVENTION

In an internal combustion engine for a vehicle, it is desirable to design an air induction system in which sound energy generation is minimized. Sound energy is generated as fresh air is drawn into the engine. Sound energy is caused by the intake air in the air feed line which creates undesirable intake noise. Resonators of various types such as a Helmholtz type, for example, have been employed to reduce engine intake noise. Such resonators typically-include a single, fixed volume chamber, with a fixed neck length and fixed neck diameter, for dissipating the intake noise.

It would be desirable to produce a variable resonator system which militates against the emission of sound energy caused by the intake air and cancels acoustical signals.

SUMMARY OF THE INVENTION

Consistent and consonant with the present invention, a variable resonator system which militates against the emission of sound energy caused by the intake air and cancels acoustical signals, has been discovered.

The continuously variable resonator system comprises:

a housing having a chamber formed therein and a neck portion adapted to provide fluid communication between the chamber and a duct;

an engine speed sensor adapted to sense a speed of an associated engine;

means for controlling at least one of a volume of the chamber, a length of the neck portion, and a diameter of the neck portion, the means for controlling in communication with the engine speed sensor, and the means for controlling at least one of the volume of the chamber, the length of the neck portion, and the diameter of the neck portion responsive to the speed sensed by the engine speed sensor, wherein controlling at least one of the volume of the chamber, the length of the neck portion, and the diameter of the neck portion facilitates attenuation of a first desired frequency of sound entering the resonator;

a noise sensor disposed within the duct;

a vibratory displacement actuator disposed in the chamber of said housing, the vibratory, displacement actuator for creating a vibratory input responsive to noise levels sensed by the noise sensor, wherein the vibratory input cancels a second desired frequency of sound entering the resonator.

BRIEF DESCRIPTION OF THE DRAWINGS

The above, as well as other objects, features, and advantages of the present invention will be understood from the detailed description of the preferred embodiments of the present invention with reference to the accompanying drawings, in which.

DETAILED DESCRIPTION OF THE PREFERRED EMBODIMENTS

Figure 1:
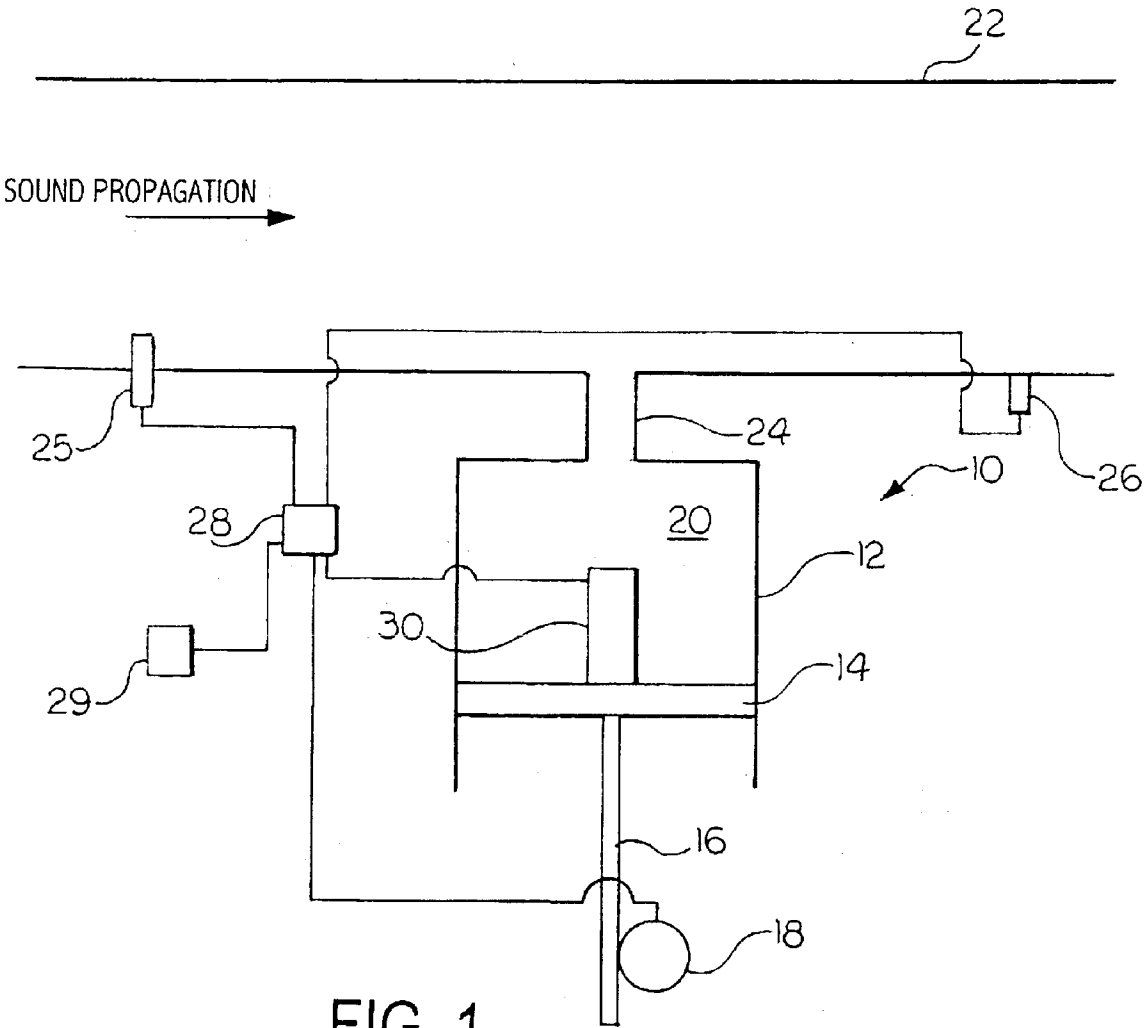
FIG. 1 is a schematic view of a first embodiment of a resonator, the resonator having means for continuously varying the mean resonator volume and means for creating a vibratory input to dynamically adjust the cancellation frequency for acoustical signals.

Referring now to the drawings, and particularly FIG. 1, there is shown generally at 10 an air resonator system incorporating the features of the invention. In the embodiment shown, a Helmholtz type resonator is used. It is understood that other resonator types could be used without departing from the scope and spirit of the invention. The air resonator system 10 includes a cylinder or housing 12. A piston 14 is reciprocatively disposed in the housing 12. A rod 16 is attached to the piston 14 and is operatively engaged with a positional controller 18 to vary a position of the piston 14 within the housing 12. The housing 12 and the piston 14 cooperate to form a variable volume resonator chamber 20. The chamber 20 communicates with a duct 22 through a resonator neck portion 24. The duct 22 is in communication with an air intake system of a vehicle (not shown).

A first noise sensor 25 is connected to the duct 22, upstream of the resonator system 10. A second noise sensor 26 is connected to the duct 22, downstream of the resonator system 10. Any conventional noise sensor 25, 26 can be used such as a microphone, for example. The first noise sensor 25 and the second noise sensor 26 are in communication with a programmable control module of PCM 28. An engine speed sensor 29 (engine not shown) is in communication with the PCM 28. The PCM 28 is in communication with and controls the positional controller 18. A vibratory displacement actuator 30 is disposed within the chamber 20 and is in communication with and controlled by the PCM 28. An audio speaker or a ceramic actuator with a vibrating diaphragm may be used as the actuator 30, for example.

In operation, the air resonator system 10 attenuates sound of varying frequencies. Air flows in the duct 22 to the engine, and sound energy or noise originates in the engine and flows from the engine to the atmosphere against the air flow. Alternatively, it is understood that the air resonator system 10 could be used in an exhaust system where the air flow and the noise flow are in the same direction, or from the engine. The noise enters the air resonator system 10 through the neck portion 24 and travels into the chamber 20. The resonator system 10 may be tuned to attenuate different sound frequencies by varying one or more of the neck 24 diameter, the neck 24 length, and the chamber 20 volume. These are known as the mean resonator properties. In the embodiment shown in FIG. 1, the air resonator system 10 is tuned by varying the chamber 20 volume through varying the position of the piston 14 within the chamber 20.

The first noise sensor 25 senses a sound level within the duct 22. The sensed level is received by the PCM 28. Based upon the noise level sensed, the PCM 28 causes the actuator 30 to create a vibratory input, or a dynamic resonator property, in the chamber 20 to prevent noise from propagating any further towards the air intake and to the atmosphere. The vibratory input of the actuator 30 is adjustable and therefore facilitates dynamic adjustment of the cancellation frequency. If the sensed noise frequency changes, the PCM 28 causes the actuator 30 to create a different vibratory input based upon the noise sensed. The second noise sensor 26 serves as an error sensor downstream of the actuator 30. The second noise sensor 26 senses a noise level and sends a signal to the PCM 28. The PCM 28 measures the difference between the output sound and a target level and facilitates further refining of the actuator 30 input. Care must be taken to avoid locating the second noise sensor 26 at a nodal point, which would result in a false reading that the noise has been attenuated.

Additionally, an engine speed is sensed by the engine speed sensor 29 and a signal is received by the PCM 28. A desired position of the piston 14 is predetermined at engine speed increments and placed in a table in the PCM 28. Thus, at a specific engine speed, the desired output is determined by table lookup in the PCM 28. Based upon the engine speed sensed, the positional controller 18 causes the piston 14 to move to the desired position to attenuate the noise. If the engine speed changes, the PCM 28 will cause the piston 14 to move to a new desired position to attenuate the noise.

The combination of varying both the mean and dynamic properties of the resonator system 10 provides wide latitude in tuning the resonator system 10 for a desired noise frequency and canceling acoustic signals or noise in the air induction system for the vehicle.

Figure 2:
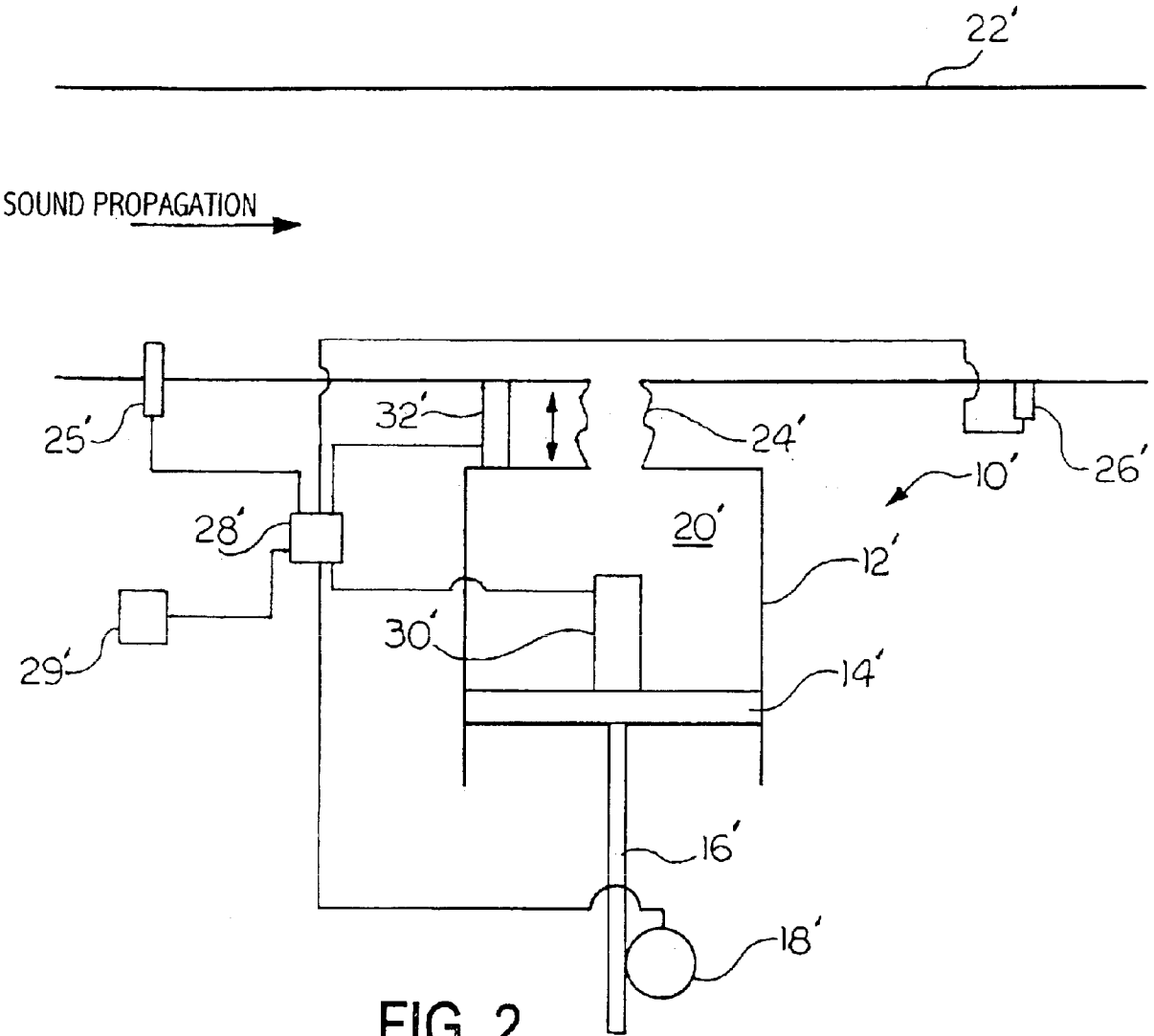
FIG. 2 is a schematic view of a second embodiment of a resonator, the resonator having means for continuously varying the mean resonator volume, means for continuously varying the mean resonator neck length, and means for creating a vibratory input to dynamically adjust the cancellation frequency for acoustical signals.

Referring now to FIG. 2, there is shown generally at 10' an air resonator system incorporating a second embodiment of the invention. In the embodiment shown, a Helmholtz type resonator is used. It is understood that other resonator types could be used without departing from the scope and spirit of the invention. The air resonator system 10' includes a cylinder or housing 12'. A piston 14' is reciprocatively disposed in the housing 12'. A rod 16' is attached to the piston 14' and is operatively engaged with a positional controller 18' to vary a position of the piston 14' within the housing 12'. The housing 12' and the piston 14' cooperate to form a variable volume resonator chamber 20'. The chamber 20' communicates with a duct 22' through a resonator neck portion 24'. The length of the neck 24' is adjustable. In the embodiment shown, a flexible neck 24' is shown. However, a neck 24' which is telescoping, for example, may be used without departing from the scope and spirit of the invention. The duct 22' is in communication with an air intake system of a vehicle (not shown).

A first noise sensor 25' is connected to the duct 22', upstream of the resonator system 10'. A second noise sensor 26' is connected to the duct 22', downstream of the resonator system 10'. Any conventional noise sensor 25', 26' can be used such as a microphone, for example. The first noise sensor 25' and the second noise sensor 26' are in communication with a programmable control module of PCM 28'. An engine speed sensor 29' (engine not shown) is in communication with the PCM 28'. The PCM 28' is in communication with and controls the positional controller 18'. A vibratory displacement actuator 30' is disposed within the chamber 20' and is in communication with and controlled by the PCM 28'. An audio speaker or a ceramic actuator with a vibrating diaphragm may be used as the actuator 30', for example. A second positional controller 32' is attached to the resonator system 10' to vary the length of the neck 24'. The PCM 28' is in communication with and controls the second positional controller 32'.

In operation, the air resonator system 10' attenuates sound of varying frequencies. Air flows in the duct 22' to the engine, and sound energy or noise originates in the engine and flows from the engine to the atmosphere against the air flow. Alternatively, it is understood that the air resonator system 10' could be used in an exhaust system where the air flow and the noise flow are in the same direction, or from the engine. The noise enters the air resonator system 10' through the neck portion 24' and travels into the chamber 20'. In the embodiment shown in FIG. 2, the air resonator system 10' is tuned by varying at least one of the chamber 20' volume by varying the position of the piston 14' within the chamber 20' and by varying the neck 24' length.

The first noise sensor 25' senses a sound level within the duct 22'. The sensed level is received by the PCM 28'. Based upon the noise level sensed, the PCM 28' causes the actuator 30' to create a vibratory input, or a dynamic resonator property, in the chamber 20' to prevent noise from propagating any further towards the air intake and to the atmosphere. The vibratory input of the actuator 30' is adjustable and therefore facilitates dynamic adjustment of the cancellation frequency. If the sensed noise frequency changes, the PCM 28' causes the actuator 30' to create a different vibratory input based upon the noise sensed. The second noise sensor 26' serves as an error sensor downstream of the actuator 30'. The second noise sensor 26' senses a noise level and sends a signal to the PCM 28'. The PCM 28' measures the difference between the output sound and a target level and facilitates further refining of the actuator 30' input. Care must be taken to avoid locating the second noise sensor 26' at a nodal point, which would result in a false reading that the noise has been attenuated.

Additionally, an engine speed is sensed by the engine speed sensor 29' and a signal is received by the PCM 28'. A desired position of the piston 14' and a desired length of the neck 24' are predetermined at engine speed increments and placed in a table in the PCM 28'. Thus, at a specific engine speed, the desired output is determined by table lookup in the PCM 28'. Based upon the engine speed sensed, the positional controller 18' causes the piston 14' to move to the desired position to attenuate the noise. Alternatively, the second actuator 32' is caused to change the length of the neck 24' to attenuate the noise as desired. If it is desired, both the volume of the chamber 20' and the length of the neck 24' can be simultaneously varied to tune the resonator system 10' to attenuate a desired noise frequency. If the engine speed changes, the PCM 28' will cause the piston 14' to move to a new desired position or cause the length of the neck 24' to change to attenuate the noise.

The combination of varying both the mean and dynamic properties of the resonator system 10' provides wide latitude in tuning the resonator system 10' for a desired noise frequency and canceling acoustic signals or noise in the air induction system for the vehicle.

Figure 3:
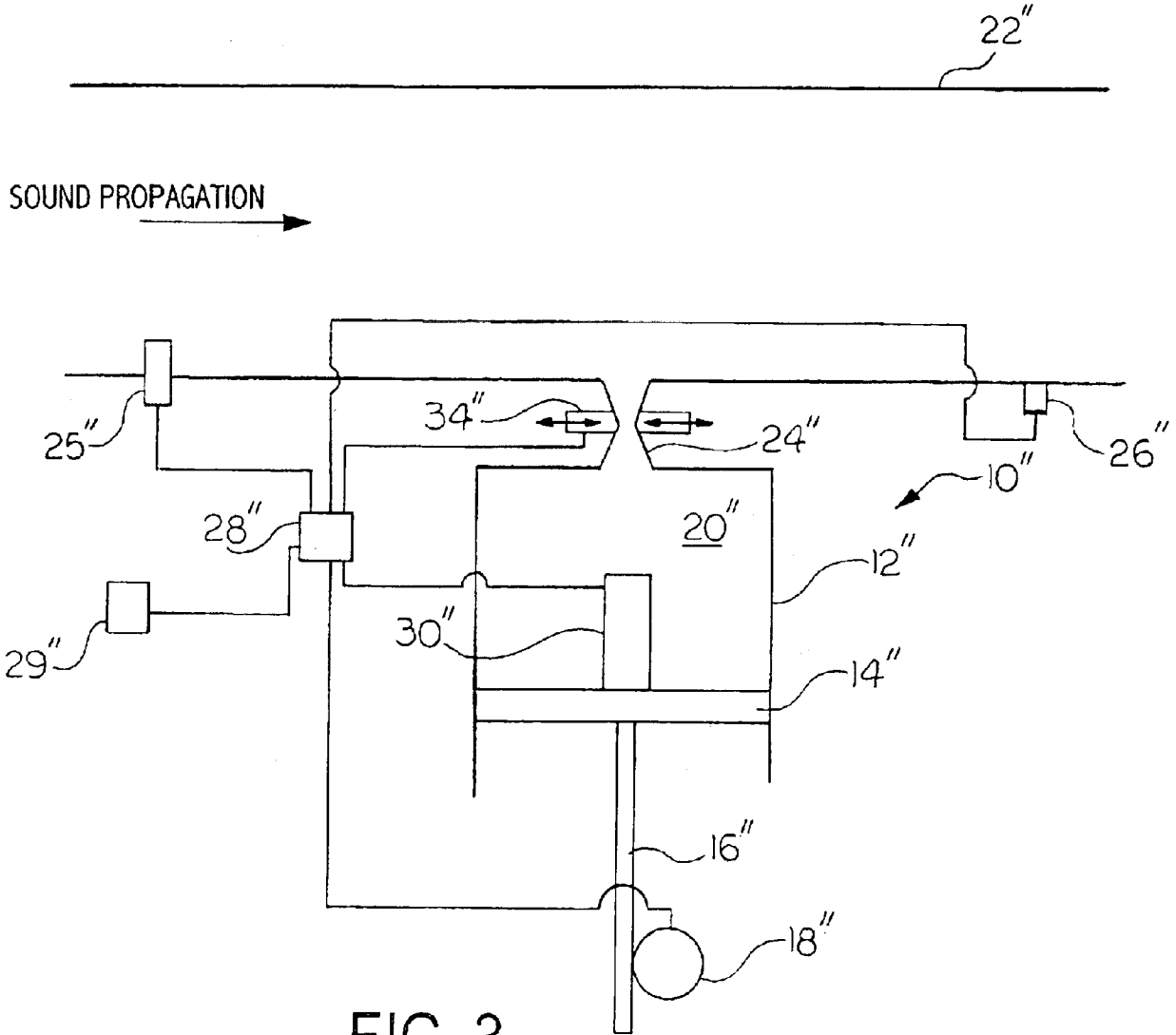
FIG. 3 is a schematic view of a third embodiment of a resonator, the resonator having means for continuously varying the mean resonator volume, means for continuously varying the mean resonator neck diameter, and means for creating a vibratory input to dynamically adjust the cancellation frequency for acoustical signals.

Referring now to FIG. 3, there is shown generally at 10" an air resonator system incorporating a third embodiment of the invention. In the embodiment shown, a Helmholtz type resonator is used. It is understood that other resonator types could be used without departing from the scope and spirit of the invention. The air resonator system 10" includes a cylinder or housing 12". A piston 14" is reciprocatively disposed in the housing 12". A rod 16" is attached to the piston 14" and is operatively engaged with a positional controller 18" to vary a position of the piston 14" within the housing 12". The housing 12" and the piston 14" cooperate to form a variable volume resonator chamber 20'. The chamber 20' communicates with a duct 22" through a resonator neck portion 24". The diameter of the neck 24" is adjustable. In the embodiment shown, a neck 24" having only a portion of the diameter adjustable is shown. However, a neck 24" where the diameter over the entire length, may be used without departing from the scope and spirit of the invention. To tune the resonator system 10", changing the neck 24" diameter only at one portion is sufficient. However, varying the neck 24" diameter over the entire length will yield similar tuning characteristics. The duct 22" is in communication with an air intake system of a vehicle (not shown).

A first noise sensor 25" is connected to the duct 22", upstream of the resonator system 10". A second noise sensor 26" is connected to the duct 22", downstream of the resonator system 10". Any conventional noise sensor 25", 26" can be used such as a microphone, for example. The first noise sensor 25" and the second noise sensor 26" are in communication with a programmable control module of PCM 28". An engine speed sensor 29" (engine not shown) is in communication with the PCM 28". The PCM 28" is in communication with and controls the positional controller 18". A vibratory displacement actuator 30" is disposed within the chamber 20" and is in communication with and controlled by the PCM 28". An audio speaker or a ceramic actuator with a vibrating diaphragm may be used as the actuator 30", for example. A third positional controller 34" is attached to the neck 24" of the resonator system 10" to vary the diameter of the neck 24". The PCM 28" is in communication with and controls the third positional controller 34".

In operation, the air resonator system 10" attenuates sound of varying frequencies. Air flows in the duct 22" to the engine, and sound energy or noise originates in the engine and flows from the engine to the atmosphere against the air flow. Alternatively, it is understood that the air resonator system 10" could be used in an exhaust system where the air flow and the noise flow are in the same direction, or from the engine. The noise enters the air resonator system 10" through the neck portion 24" and travels into the chamber 20". In the embodiment shown in FIG. 3, the air resonator system 10" is tuned by varying at least one of the volume of the chamber 20" by varying the position of the piston 14" within the chamber 20" and by varying the diameter of the neck 24".

The first noise sensor 25" senses a sound level within the duct 22". The sensed level is received by the PCM 28". Based upon the noise level sensed, the PCM 28" causes the actuator 30" to create a vibratory input, or a dynamic resonator property, in the chamber 20" to prevent noise from propagating any further towards the air intake and to the atmosphere. The vibratory input of the actuator 30" is adjustable and therefore facilitates dynamic adjustment of the cancellation frequency. If the sensed noise frequency changes, the PCM 28" causes the actuator 30" to create a different vibratory input based upon the noise sensed. The second noise sensor 26" serves as an error sensor downstream of the actuator 30". The second noise sensor 26" senses a noise level and sends a signal to the PCM 28". The PCM 28" measures the difference between the output sound and a target level and facilitates further refining of the actuator 30" input. Care must be taken to avoid locating the second noise sensor 26" at a nodal point, which would result in a false reading that the noise has been attenuated.

Additionally, an engine speed is sensed by the engine speed sensor 29" and a signal is received by the PCM 28". A desired position of the piston 14" and a desired diameter of the neck 24" are predetermined at engine speed increments and placed in a table in the PCM 28". Thus, at a specific engine speed, the desired output is determined by table lookup in the PCM 28". Based upon the engine speed sensed, the positional controller 18" causes the piston 14" to move to the desired position to attenuate the noise. Alternatively, the third positional controller 34" causes the diameter of the neck 24" to change to attenuate the noise as desired. If it is desired, both the volume of the chamber 20" and the diameter of the neck 24" can be simultaneously varied to tune the resonator system 10" to attenuate a desired noise frequency. If the engine speed changes, the PCM 28" will cause the piston 14" to move to a new desired position or cause the diameter of the neck 24" to change to attenuate the noise.

The combination of varying both the mean and dynamic properties of the resonator system 10" provides wide latitude in tuning the resonator system 10" for a desired noise frequency and canceling acoustic signals or noise in the air induction system for the vehicle.

Figure 4:
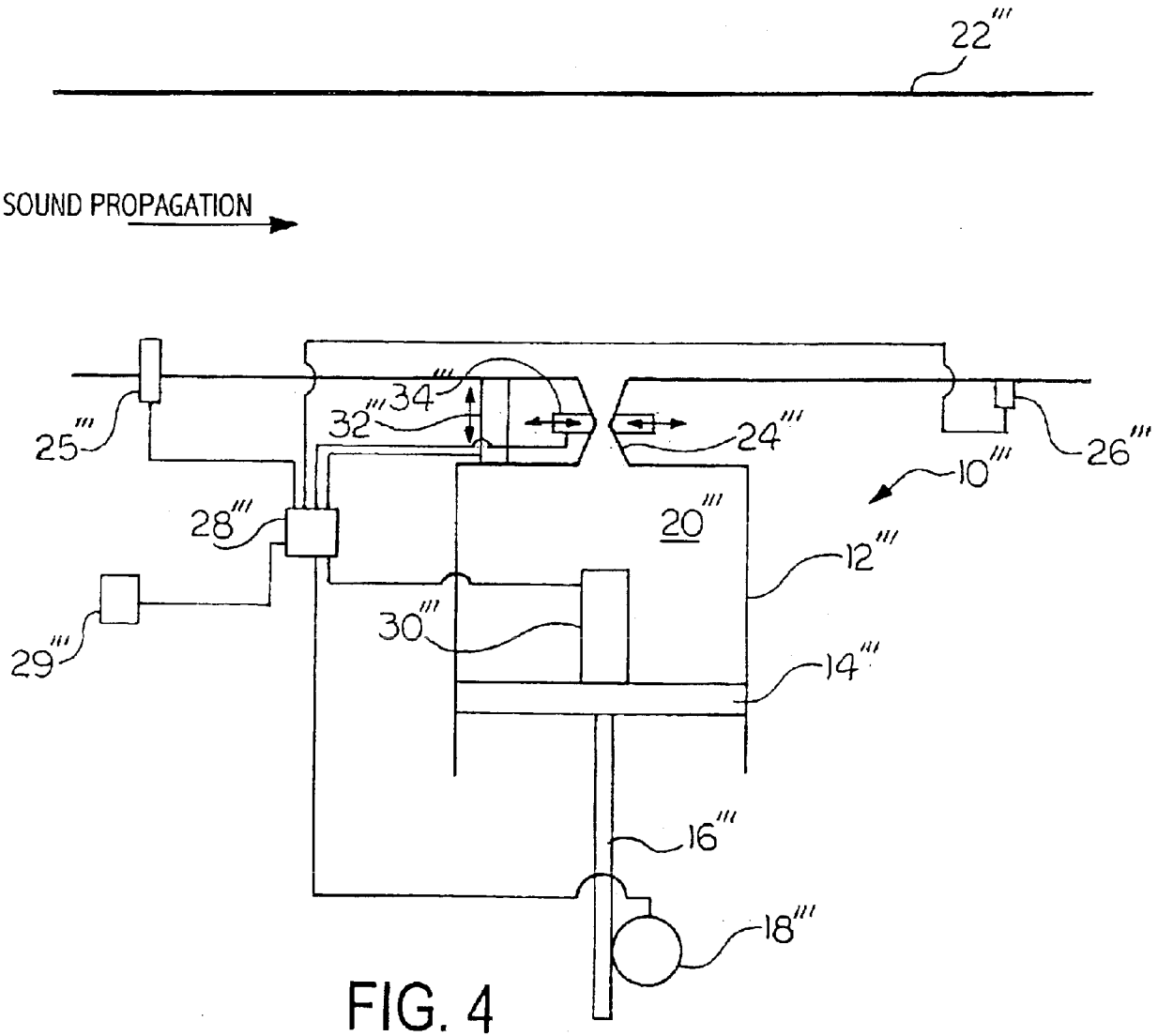
FIG. 4 is a schematic view of a fourth embodiment of a resonator, the resonator having means for continuously varying the mean resonator volume, means for continuously varying the mean resonator neck diameter, means for continuously varying the mean resonator neck length, and means for creating a vibratory input to dynamically adjust the cancellation frequency for acoustical signals.

Referring now to FIG. 4, there is shown generally at 10'" an air resonator system incorporating a fourth embodiment of the invention. In the embodiment shown, a Helmholtz type resonator is used. It is understood that other resonator types could be used without departing from the scope and spirit of the invention. The air resonator system 10'" includes a cylinder or housing 12'". A piston 14'" is reciprocatively disposed in the housing 12'". A rod 16'" is attached to the piston 14'" and is operatively engaged with a positional controller 18'" to vary a position of the piston 14'" within the housing 12'". The housing 12'" and the piston 14'" cooperate to form a variable volume resonator chamber 20'". The chamber 20'" communicates with a duct 22'" through a resonator neck portion 24'". The length and diameter of the neck 24'" are adjustable. In the embodiment shown, a flexible neck 24'" is shown. However, a neck 24'" which is telescoping, for example, may be used without departing from the scope and spirit of the invention. Also, in the embodiment shown, a neck 24'" having only a portion of the diameter adjustable is shown. However, a neck 24'" where the diameter over the entire length, may be used without departing from the scope and spirit of the invention. To tune the resonator system 10'", changing the neck 24'" diameter only at one portion is sufficient. However, varying the neck 24'" diameter over the entire length will yield similar tuning characteristics. The duct 22''' is in communication with an air intake system of a vehicle (not shown).

A first noise sensor 25''' is connected to the duct 22''', upstream of the resonator system 10'''. A second noise sensor 26''' is connected to the duct 22''', downstream of the resonator system 10'''. Any conventional noise sensor 25''', 26''' can be used such as a microphone, for example. The first noise sensor 25''' and the second noise sensor 26''' are in communication with a programmable control module of PCM 28'''. An engine speed sensor 29''' (engine not shown) is in communication with the PCM 28'''. The PCM 28''' is in communication with and controls the positional controller 18'''. A vibratory displacement actuator 30''' is disposed within the chamber 20''' and is in communication with and controlled by the PCM 28'''. An audio speaker or a ceramic actuator with a vibrating diaphragm may be used as the actuator 30''', for example. A second positional controller 32''' is attached to the resonator system 10''' to vary the length of the neck 24'''. The PCM 28''' is in communication with and controls the second positional controller 32'''. A third positional controller 34''' is attached to the neck 24''' of the resonator system 10''' to vary the diameter of the neck 24'''. The PCM 28''' is in communication with and controls the third positional controller 34'''.

In operation, the air resonator system 10''' attenuates sound of varying frequencies. Air flows in the duct 22''' to the engine, and sound energy or noise originates in the engine and flows from the engine to the atmosphere against the air flow. Alternatively, it is understood that the air resonator system 10''' could be used in an exhaust system where the air flow and the noise flow are in the same direction, or from the engine. The noise enters the air resonator system 10''' through the neck portion 24''' and travels into the chamber 20'''. In the embodiment shown in FIG. 4, the air resonator system 10''' is tuned by varying at least one of the volume of the chamber 20''' by varying the position of the piston 14''' within the chamber 20'''; by varying the length of the neck 24''', and by varying the diameter of the neck 24'''.

The first noise sensor 25''' senses a sound level within the duct 22'''. The sensed level is received by the PCM 28'''. Based upon the noise level sensed, the PCM 28''' causes the actuator 30''' to create a vibratory input, or a dynamic resonator property, in the chamber 20''' to prevent noise from propagating any further towards the air intake and to the atmosphere. The vibratory input of the actuator 30''' is adjustable and therefore facilitates dynamic adjustment of the cancellation frequency. If the sensed noise frequency changes, the PCM 28''' causes the actuator 30''' to create a different vibratory input based upon the noise sensed. The second noise sensor 26''' serves as an error sensor downstream of the actuator 30'''. The second noise sensor 26''' senses a noise level and sends a signal to the PCM 28'''. The PCM 28''' measures the difference between the output sound and a target level and facilitates further refining of the actuator 30''' input. Care must be taken to avoid locating the second noise sensor 26''' at a nodal point, which would result in a false reading that the noise has been attenuated.

Additionally, an engine speed is sensed by the engine speed sensor 29''' and a signal is received by the PCM 28'''. A desired position of the piston 14''', a desired length of the neck 24''', and a desired diameter of the neck 24''' are predetermined at engine speed increments and placed in a table in the PCM 28'''. Thus, at a specific engine speed, the desired outputs are determined by table lookup in the PCM 28'''. Based upon the engine speed sensed, the positional controller 18''' causes the piston 14''' to move to the desired position to attenuate the noise. The second positional controller 32''' can also cause the length of the neck 24''' to change to attenuate the noise as desired. Alternatively, the third positional controller 34''' causes the diameter of the neck 24''' to change to attenuate the noise as desired. If it is desired, the volume of the chamber 20''', the length of the neck 24''', and the diameter of the neck 24''', can all be simultaneously varied, or any combination thereof, to tune the resonator system 10''' to attenuate a desired noise frequency. If the engine speed changes, the PCM 28''' will cause the piston 14''' to move to a new desired position, cause the length of the neck 24''' to change, or cause the diameter of the neck 24''' to change to attenuate the noise.

The combination of varying both the mean and dynamic properties of the resonator system 10''' provides wide latitude in tuning the resonator system 10''' for a desired noise frequency and canceling acoustic signals or noise in the air induction system for the vehicle.

Figure 5:
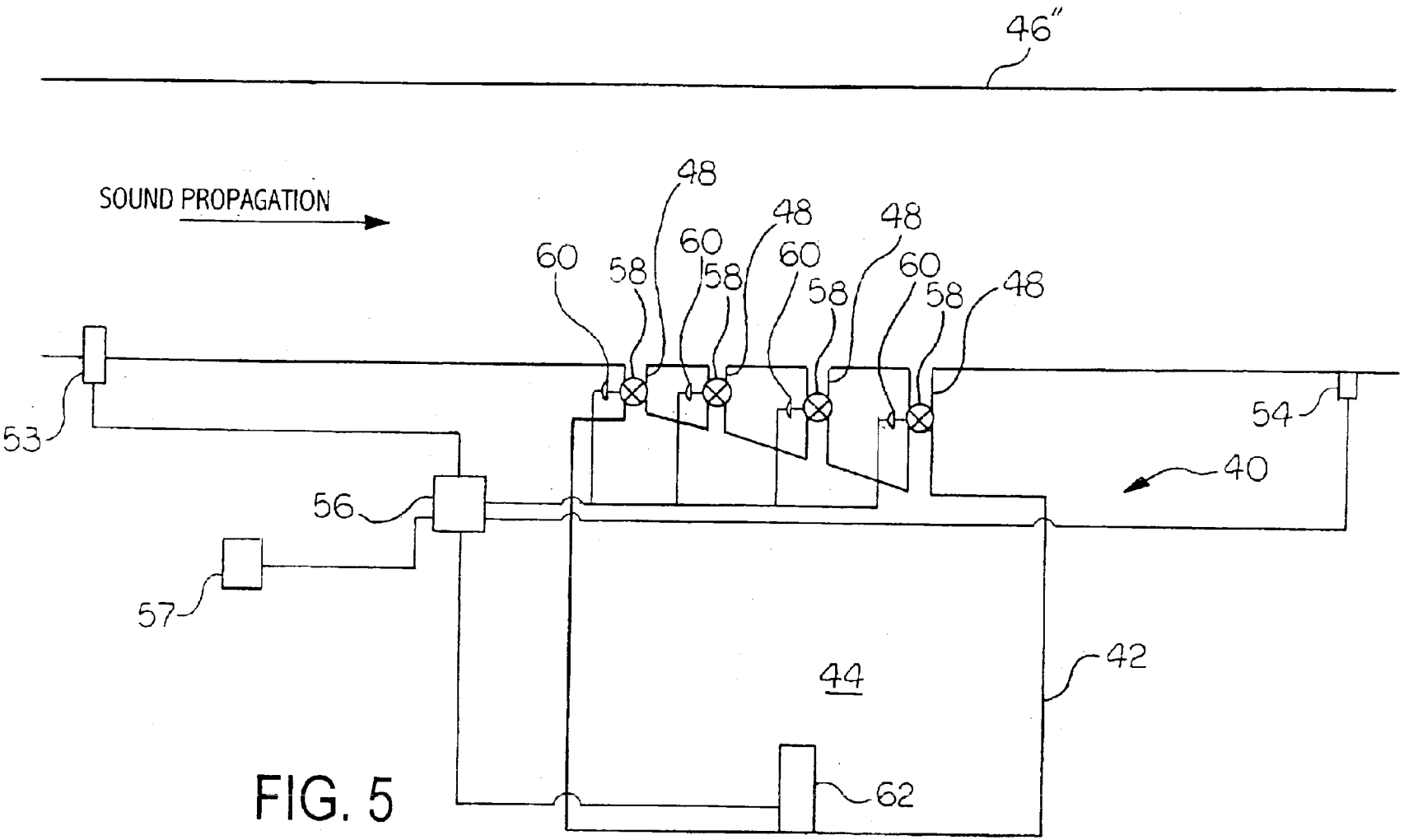
FIG. 5 is a schematic view of a fifth embodiment of a resonator, the resonator having means for tuning including a plurality of necks of differing lengths with valves disposed therein and means for creating a vibratory input to dynamically adjust the cancellation frequency for acoustical signals.

Referring now to FIG. 5, there is shown generally at 40 an air resonator system incorporating a fifth embodiment of the invention. In the embodiment shown, a Helmholtz type resonator is used. It is understood that other resonator types could be used without departing from the scope and spirit of the invention. The air resonator system 40 includes a housing 42 which defines a resonator chamber 44. The chamber 44 communicates with a duct 46 through a plurality of neck portion portions 48. In the embodiment shown, four neck portions 48 are included in the resonator system 40. It is understood that more or fewer neck portions 48 could be used as desired without departing from the scope and spirit of the invention. A solenoid valve 58 is disposed in each of the neck portions 48. An actuator or a positional controller 60 is disposed on each of the solenoid valves 58. It is understood that other valve types and other actuator types could be used without departing from the scope and spirit of the invention. The duct 46 is in communication with an air intake system of a vehicle (not shown).

A first noise sensor 53 is connected to the duct 46, upstream of the air resonator system 40. A second noise sensor 54 is connected to the duct 46, downstream of the air resonator system 40. Any conventional noise sensor 53, 54 can be used such as a microphone, for example. The first noise sensor 53 and the second noise sensor 54 are in communication with a programmable control module or PCM 56. An engine speed sensor 57 (engine not shown) is in communication with the PCM 56. The PCM 56 is in communication with and controls each of the positional controllers 60.

A vibratory displacement actuator 62 is disposed within the chamber 44 and is in communication with and controlled by the PCM 56. An audio speaker or a ceramic actuator with a vibrating diaphragm may be used as the actuator 62, for example.

In operation, the air resonator system 40 attenuates sound of varying frequencies. Air flows in the duct 46 to the engine, and sound energy or noise originates in the engine and flows from the engine to the atmosphere against the air flow. Alternatively, it is understood that the air resonator system 40 could be used in an exhaust system where the air flow and the noise flow are in the same direction, or from the engine. The noise enters the air resonator system 40 through at least one of the neck portions 48 and travels into the chamber 44. The resonator system 40 may be tuned to attenuate different sound frequencies by varying one or more of the neck diameter, the neck length, and the chamber 44 volume. These are known as the mean resonator properties.

In the embodiment shown in FIG. 5, the resonator system 40 is tuned to attenuate different sound frequencies by selectively opening and closing the solenoid valves 58 to vary a length of the neck portion 48. By using a proportional control type solenoid valve 58, a diameter of the neck portion 48 can be controlled by controlling the degree which the solenoid valve 58 is open, thus changing two of the mean resonator properties. It is understood if it is desired to control only a neck length that on/off type solenoid valves can be used. It is also understood that by opening particular combinations of the solenoid valves 58 to change the diameter of the neck portion 48 and/or the length of the neck portion 48 the resonator system 40 can be tuned.

The first noise sensor 53 senses a sound level within the duct 46. The sensed level is received by the PCM 56. Based upon the noise level sensed, the PCM 56 causes the actuator 62 to create a vibratory input, or a dynamic resonator property, in the chamber 44 to prevent noise from propagating any further towards the air intake and to the atmosphere. The vibratory input of the actuator 62 is adjustable and therefore facilitates dynamic adjustment of the cancellation frequency. If the sensed noise frequency changes, the PCM 56 causes the actuator 62 to create a different vibratory input based upon the noise sensed. The second noise sensor 54 serves as an error sensor downstream of the actuator 62. The second noise sensor 54 senses a noise level and sends a signal to the PCM 56. The PCM 56 measures the difference between the output sound and a target level and facilitates further refining of the actuator 62 input. Care must be taken to avoid locating the second noise sensor 54 at a nodal point, which would result in a false reading that the noise has been attenuated.

Additionally, an engine speed is sensed by the engine speed sensor 57 and a signal is received by the PCM 56. A desired position of the solenoid valves 58 are predetermined at engine speed increments and placed in a table in the PCM 56. Thus, at a specific engine speed, the desired outputs are determined by table lookup in the PCM 56. Based upon the engine speed sensed, the PCM 56 causes the positional controller 60 to open the appropriate combination of solenoid valves 58 disposed in the neck portion 48 to provide the desired tuning which will attenuate the noise. If the engine speed changes, the PCM 56 will cause a different combination of positional controllers 60 to open a different combination of solenoid valves 58 disposed in the neck portion 48 to provide the desired tuning which will attenuate the noise. By using the proportional control type solenoid valve 58, the resonator system 40 provides both an incremental change in the neck portion 48 length and/or a continuous change in the neck portion 48 diameter.

The combination of varying both the mean and dynamic properties of the resonator system 10 provides wide latitude in tuning the resonator system 10 for a desired noise frequency and canceling acoustic signals or noise in the air induction system for the vehicle.

Figure 6:
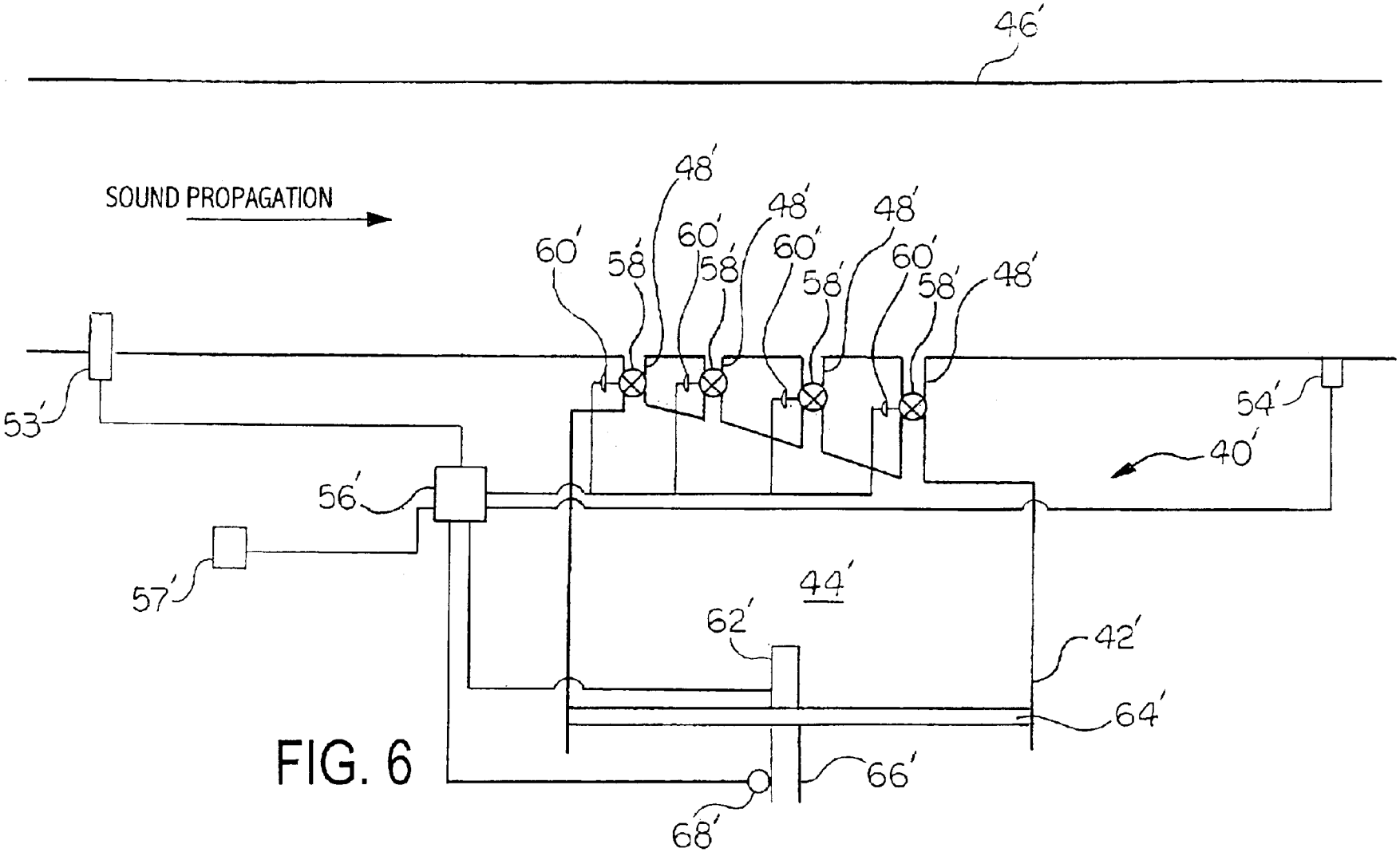
FIG. 6 is a schematic view of a sixth embodiment of a resonator, the resonator having means for tuning including a plurality of necks of differing lengths with valves disposed therein, means for continuously varying the mean resonator volume, and means for creating a vibratory input to dynamically adjust the cancellation frequency for acoustical signals.

Referring now to FIG. 6, there is shown generally at 40' an air resonator system incorporating a sixth embodiment of the invention. In the embodiment shown, a Helmholtz type resonator is used. It is understood that other resonator types could be used without departing from the scope and spirit of the invention. The air resonator system 40' includes a housing 42' which defines a resonator chamber 44'. A piston 64' is reciprocatively disposed in the housing 42'. A rod 66' is attached to the piston 64' and is operatively engaged with an actuator or a positional controller 68' to vary a position of the piston 64' within the housing 42'. The housing 42' and the piston 64' cooperate to vary the volume of the chamber 44'.

The chamber 44' communicates with a duct 46' through a plurality of neck portions 48'. In the embodiment shown, four neck portions 48' are included in the resonator system 40'. It is understood that more or fewer neck portions 48' could be used as desired without departing from the scope and spirit of the invention. A solenoid valve 58' is disposed in each of the neck portions 48'. An actuator or a positional controller 60' is connected to each of the solenoid valves 58'. It is understood that other valve types and other actuator types could be used without departing from the scope and spirit of the invention. The duct 46' is in communication with an air intake system of a vehicle (not shown).

A first noise sensor 53' is connected to the duct 46', upstream of the air resonator system 40'. A second noise sensor 54' is connected to the duct 46', downstream of the air resonator system 40'. Any conventional noise sensor 53', 54' can be used such as a microphone, for example. The first noise sensor 53' and the second noise sensor 54' are in communication with a programmable control module or PCM 56'. An engine speed sensor 57' (engine not shown) is in communication with the PCM 56'. The PCM 56' is in communication with and controls each of the positional controllers 60'.

A vibratory displacement actuator 62' is disposed within the chamber 44' and is in communication with and controlled by the PCM 56'. An audio speaker or a ceramic actuator with a vibrating diaphragm may be used as the actuator 62', for example.

In operation, the air resonator system 40' attenuates sound of varying frequencies. Air flows in the duct 46' to the engine, and sound energy or noise originates in the engine and flows from the engine to the atmosphere against the air flow. Alternatively, it is understood that the air resonator system 40' could be used in an exhaust system where the air flow and the noise flow are in the same direction, or from the engine. The noise enters the air resonator system 40' through at least one of the neck portions 48' and travels into the chamber 44'. The resonator system 40' may be tuned to attenuate different sound frequencies by varying one or more of the neck diameter, the neck length, and the chamber 44' volume. These are known as the mean resonator properties. In the embodiment shown in FIG. 6, the resonator system 40' is tuned to attenuate different sound frequencies by selectively opening and closing the solenoid valves 58' to vary a length of the neck portion 48', or by opening particular combinations of solenoid valves 58' to change the effective length and area of the neck portion 48'. By using a proportional control type solenoid valve 58', a diameter of the neck portion 48' can be controlled by controlling the degree which the solenoid valve 58' is open, thus changing two of the mean resonator properties. It is understood if it is desired to control only a neck length that on/off type solenoid valves can be used.

The first noise sensor 53' senses a sound level within the duct 46'. The'sensed level is received by the PCM 56'. Based upon the noise level sensed, the PCM 56' causes the actuator 62' to create a vibratory input, or a dynamic resonator property, in the chamber 44' to prevent noise from propagating any further towards the air intake and to the atmosphere. The vibratory input of the actuator 62' is adjustable and therefore facilitates dynamic adjustment of the cancellation frequency. If the sensed noise frequency changes, the PCM 56' causes the actuator 62' to create a different vibratory input based upon the noise sensed. The second noise sensor 54' serves as an error sensor downstream of the actuator 62'. The second noise sensor 54' senses a noise level and sends a signal to the PCM 56'. The PCM 56' measures the difference between the output sound and a target level and facilitates further refining of the actuator 62' input. Care must be taken to avoid locating the second noise sensor 54' at a nodal point, which would result in a false reading that the noise has been attenuated.

Additionally, an engine speed is sensed by the engine speed sensor 57' and a signal is received by the PCM 56'. A desired position of the solenoid valves 58 and a desired position of the piston 64' are predetermined at engine speed increments and placed in a table in the PCM 56'. Thus, at a specific engine speed, the desired output is determined by table lookup in the PCM 56'. Based upon the engine speed sensed, the PCM 56' causes the positional controller 60' to open the appropriate combination of solenoid valves 58' disposed in the neck portion 48' having the desired length and/or total area which will attenuate the noise. If the engine speed changes, the PCM 56' will cause a different positional controller 60' to open the solenoid valve 58' disposed in the neck portion 48' having the desired length which will attenuate the noise. By using the proportional control type solenoid valve 58', the resonator system 40' provides both an incremental change in the neck portion 48' length, and a continuous change in the neck portion 48' diameter. The noise can also be attenuated by varying the chamber 44' volume by varying the position of the piston 64' within the chamber 44'. Based upon the engine speed, the PCM 56' causes the positional controller 68' to move the piston 64' to a desired position to attenuate the noise. If the engine speed changes, the PCM 56' will cause the piston 64' to move to a new desired position to attenuate the noise.

If it is desired, the volume of the chamber 44', the length of the neck portion 48', and the diameter of the neck portion 48', can all be simultaneously varied, or any combination thereof, to tune the resonator system 40' to attenuate a desired noise frequency. If the engine speed changes, the PCM 56' will cause the piston 64' to move to a new desired position, cause the length of the neck portion 48' to change, or cause the diameter of the neck portion 48' to change to attenuate the noise.

The combination of varying both the mean and dynamic properties of the resonator system 40' provides wide latitude in tuning the resonator system 40' for a desired noise frequency and canceling acoustic signals or noise in the air induction system for the vehicle.

Two noise control structures have been discussed above and illustrated in the drawings. First is a system having a variable geometry resonator wherein at least one of a neck length, a neck diameter, and a resonator volume are changed to attenuate a desired noise. This type of system can be used for applications requiring the modification of a single noise frequency at each engine speed. As disclosed for the invention, the variable geometry system can incorporate continuously variable or discretely variable systems. The second system is an active noise system incorporating an actuator to create a vibratory input to cancel noise. A system of this type can be used for applications requiring the modification of multiple frequencies at each engine speed. However, using an active system alone can result in large, heavy, and expensive actuator systems. By combining the two systems, a wide range of complex noises can be attenuated and the size, weight, and cost of the actuator for the active noise system can be minimized.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A variable tuned resonator comprising:

a housing having a chamber formed therein and a neck portion adapted to provide fluid communication between the chamber and a duct;

an engine speed sensor adapted to sense a speed of an associated engine;

control means coupled to said engine speed sensor for controlling at least one of a volume of the chamber, a length of the neck portion, and a diameter of the neck portion responsive to the speed sensed by said engine speed sensor, wherein controlling at least one of the volume of the chamber, the length of the neck portion, and the diameter of the neck portion tunes attenuation to a desired frequency of sound in the duct;

a noise sensor responsive to noise within said duct;

a vibratory displacement actuator disposed in the chamber of said housing, said vibratory displacement actuator for creating a vibratory input responsive to noise parameters sensed by said noise sensor, wherein the vibratory input cancels a desired frequency of sound in the duct.

2. The resonator according to claim 1, wherein said control means controls at least two of the volume of the chamber, the length of the neck portion, and the diameter of the neck portion simultaneously.

3. The resonator according to claim 1, wherein said control means controls all of the volume of the chamber, the length of the neck portion, and the diameter of the neck portion simultaneously.

4. The resonator according to claim 1, wherein said control means includes a piston disposed within the chamber to control the volume of the chamber.

5. The resonator according to claim 1, wherein said control means includes a positional controller for adjusting the length of the neck portion.

6. The resonator according to claim 1, wherein said control means includes a positional controller for adjusting the diameter of the neck portion.

7. The resonator according to claim 1, including a plurality of neck portions adapted to provide fluid communication between the chamber and the duct, each of said neck portions having a different neck length.

8. The resonator according to claim 7, wherein said control means includes a solenoid valve disposed in each of said neck portions, the solenoid valves adapted to be selectively opened and closed.

9. The resonator according to claim 8, wherein the solenoid valve disposed in each of said neck portions is an on/off type.

10. The resonator according to claim 8, wherein the solenoid valve disposed in each of said neck portions is a proportional control type, wherein a neck diameter is controlled by controlling a degree which the solenoid valve is open.

11. The resonator according to claim 1, wherein said vibratory displacement actuator is adjustable to facilitate dynamic adjustment of a cancellation frequency.

12. The resonator according to claim 1, wherein said control means is a programmable control module.

13. A variable tuned resonator comprising:

a housing having a chamber formed therein and a neck portion adapted to provide fluid communication between the chamber and a duct;

a piston disposed within the chamber, said piston being selectively reciprocable to thereby change a volume of the chamber, wherein changing the volume of the chamber tunes attenuation to a desired frequency of sound in the duct;

an engine speed sensor adapted to sense a speed of an associated engine;

a noise sensor connected to the duct;

a vibratory displacement actuator disposed in the chamber of said housing; and a programmable control module in communication with said noise sensor and said engine speed sensor, said programmable control module adapted to control the reciprocation of said piston in response to the speed sensed by said engine speed sensor, said programmable control module adapted to control said vibratory displacement actuator to create a vibratory input responsive to noise parameters sensed by said noise sensor, wherein the vibratory input cancels a desired frequency of sound in the duct.

14. The resonator according to claim 13, including a positional controller for adjusting a length of the neck portion, said programmable control module adapted to control the positional controller in response to the speed sensed by said engine speed sensor.

15. The resonator according to claim 13, including a positional controller for adjusting a diameter of the neck portion, said programmable control module adapted to control the positional controller in response to the speed sensed by said engine speed sensor.

16. A variable tuned resonator comprising:

a housing having a chamber formed therein and a plurality of neck portions adapted to provide fluid communication between the chamber and a duct, each of the neck portions having a different neck length;

a solenoid valve disposed in each of the neck portions, the solenoid valves adapted to be selectively opened and closed, whereby opening and closing of the solenoid valve facilitates selection of a desired neck length;

an engine speed sensor adapted to sense a speed of an associated engine; and a programmable control module in communication with said engine speed sensor, said programmable control module adapted to control the opening and closing of said solenoid valves in response to the speed sensed by said engine speed sensor;

wherein selection of the desired neck length tunes attenuation to a desired frequency of sound in the duct.

17. The resonator according to claim 16, wherein said solenoid valve disposed in each of the neck portions is a proportional control type, wherein a neck diameter is controlled by controlling a degree which the solenoid valve is open, wherein controlling the neck diameter tunes attenuation to a desired frequency of sound in the duct.

18. The resonator according to claim 16, including a noise sensor responsive to noise within the duct and a vibratory displacement actuator disposed in the chamber of said housing, said noise sensor in communication with said programmable control module, said programmable control module adapted to control said vibratory displacement actuator to create a vibratory input responsive to noise levels sensed by said noise sensor, wherein the vibratory input cancels a desired frequency of sound in the duct.

19. The resonator according to claim 18, including a second noise sensor responsive to noise within the duct and in communication with said programmable control module, wherein said second noise sensor facilitates further refining of the vibratory displacement actuator vibratory input.

20. The resonator according to claim 16, including a piston disposed within the chamber, said piston being selectively reciprocable to thereby change a volume of the chamber, wherein changing the volume of the chamber tunes attenuation to a desired frequency of sound in the duct.

* * * * *